US005981127A

United States Patent [19]

Nishiguchi et al.

[11] Patent Number: 5,981,127

[45] Date of Patent: Nov. 9, 1999

[54] MAGNETIC CARRIER AND DEVELOPER COMPRISING THE CARRIER FOR DEVELOPING LATENT ELECTRO-STATIC IMAGES

[75] Inventors: Yasuo Nishiguchi; Susumu Kikuchi, both of Tokyo; Yoshio Ozawa, Mie; Hisashi Mukataka, Tokyo, all of Japan

[73] Assignee: Kyocera Corporation, Kyoto, Japan

[21] Appl. No.: 08/872,967

[22] Filed: Jun. 11, 1997

Related U.S. Application Data

[63] Continuation of application No. 08/571,286, Dec. 12, 1995, abandoned, which is a continuation of application No. 08/192,168, Feb. 4, 1994, abandoned.

[30] Foreign Application Priority Data

| | | | |
|---|---|---|---|
| Feb. 5, 1993 | [JP] | Japan | 5-042069 |
| Sep. 30, 1993 | [JP] | Japan | 5-268373 |
| Dec. 28, 1993 | [JP] | Japan | 5-354674 |

[51] Int. Cl.[6] ..... G03G 9/107

[52] U.S. Cl. ..... 430/108; 430/111

[58] Field of Search ..... 430/108, 111, 430/106.6

[56] References Cited

U.S. PATENT DOCUMENTS

| | | | |
|---|---|---|---|
| 3,895,125 | 7/1975 | Tsuchiya et al. | 430/111 |
| 4,040,969 | 8/1977 | Jones | 430/111 |
| 4,111,823 | 9/1978 | Kobayashi et al. | 430/111 |
| 4,137,188 | 1/1979 | Uetake et al. | 430/111 |
| 4,957,840 | 9/1990 | Sakashita et al. | 430/111 |
| 5,318,873 | 6/1994 | Kawamura et al. | 430/106.6 |
| 5,346,791 | 9/1994 | Ozawa et al. | 430/106.6 |

FOREIGN PATENT DOCUMENTS

| | | |
|---|---|---|
| 0086444 | 8/1983 | European Pat. Off. . |
| 0188844 | 7/1986 | European Pat. Off. . |
| 0431830 | 6/1991 | European Pat. Off. . |
| 62-31864 | 2/1987 | Japan . |
| 2-129654 | 5/1990 | Japan . |

OTHER PUBLICATIONS

European Search Report, Jun. 27, 1994, Appl. No. 94101738.6.

Diamond, Arthur S., *Handbook of Imaging Materials*, New York: Marcel–Dekker, Inc., 1991, pp. 201–205 & 222–224.

Borsenberger, Paul M., *Organic Photoreceptors for Imaging Systems*, New York: Marcel–Dekker, Inc., 1993, pp. 10–13.

*Primary Examiner*—Christopher D. Rodee

*Attorney, Agent, or Firm*—Loeb & Loeb LLP

[57] ABSTRACT

A magnetic carrier for use in a developer for developing latent electrostatic images is composed of magnetic carrier particles with a particle size of 35 $\mu$m or less in an amount of 15 wt. % or more, and a developer is composed of the above carrier and a toner. An image formation method is composed of the steps of (a) uniformly charging the surface of a photoconductor to a predetermined polarity, (b) forming latent electrostatic images including low potential portions and high potential portions on the photoconductor by subjecting the charged surface of the photoconductor to selective light radiation corresponding to light images, thereby selectively reducing the potential of the surface of the photoconductor, and (c) developing the thus formed latent electrostatic images to visible toner images by bringing the developer into contact with the latent-electrostatic-images-bearing photoconductor.

7 Claims, 3 Drawing Sheets

MAGNETIC CARRIER AND DEVELOPER COMPRISING THE CARRIER FOR DEVELOPING LATENT ELECTRO-STATIC IMAGES

This is a continuation of application Ser. No. 08/571,286 filed on Dec. 12, 1995, now abandoned, which is itself a continuation of application Ser. No. 08/192,168 filed on Feb. 4, 1994, also abandoned.

BACKGROUND OF THE INVENTION

1. Field of the Invention

The present invention relates to a carrier, a developer, and an electrophotographic photoconductor for use in electrophotography, and to an electrophotographic image formation method capable of forming images on an electrophotographic photoconductor with a relatively low charging potential by the application of a low developing bias voltage thereto.

2. Discussion of Background

Since the invention of electrophotography by C. F. Carlson as disclosed as a Carlson process in U.S. Pat. No. 2,297,691, various improvements have been proposed based on the Carlson process.

Electrophotography, a representative example of which is the Carlson process, is currently widely used. The basic process of electrophotography comprises the steps of uniformly charging the surface of a photoconductor, selectively exposing the uniformly charged surface of the photoconductor to a light image, thereby forming a latent electrostatic image corresponding to the light image on the surface of the photoconductor, developing the latent electrostatic image to a visible toner image by a developer, transferring the toner image from the surface of the photoconductor to an image receiving medium, and fixing the toner image on the image receiving medium.

Conventional main methods for developing electrostatic latent images are a two-component development method using a two-component developer comprising a carrier and a toner, and a one-component jumping development method using a one-component developer. comprising one component. For example, in the case of a conventional two-component developer comprising a toner and an electrically-insulating carrier such as a resin-coated ferrite, a carrier with an average particle size of about 80 $\mu$m is used as the electrically-insulating carrier, and the concentration of the toner in the developer is set in the range from about 3 to 5 wt. %.

In the development step of the above-mentioned conventional development methods, a toner which is a colored resin powder is caused to be selectively deposited in a development area of the surface of a photoconductor in which latent electrostatic images to be developed are formed. On the other hand, in a non-development area of the surface of the photoconductor, the toner is caused not to be deposited. In order to carry out the above-mentioned development, it is required that the amount of magnetic particles contained in the toner be appropriately adjusted, or the surface potential of the photoconductor be set at about 500 V or more in the charging step, the potential difference between a high potential portion and a low potential portion in latent electrostatic images formed in the exposure step be set at about 400 V or more, and a developing bias electric field in the development step be set at about 500 V/mm or more. Furthermore, in this case, an electrical field of about 200 V/mm or more must be applied for elimination of the fogging from images is required in the development step.

To meet the above-mentioned requirements, a photoconductive material with a chargeability of about 500 V or more is required for the photoconductor. Therefore, there are considerable restrictions on the selection of a material for the photoconductor. In addition, since the charging potential required for the photoconductor is so high that the thickness of a photoconductive layer of the photoconductor has to be increased. For instance, in the case of an amorphous silicon (a-silicon) based photoconductive layer is employed, since the voltage resistance of the photoconductive layer is 12 V/$\mu$m, the a-silicon based photoconductive layer must have a thickness of 34 $\mu$m or more in order to charge the photoconductive layer to a charging potential of about 500 V or more. In the case of an organic photoconductor (OPC), an organic photoconductive layer thereof must have a thickness of 20 $\mu$m or more.

In the case of an a-silicon based photoconductor, since an a-silicon based photoconductive layer thereof is generally fabricated by a plasma glow discharging method, the deposition rate of the photoconductive layer is so small that the manufacturing cost of the a-silicon based photoconductor and imperfections or defects thereof increase in proportion to the increase in the thickness of the a-silicon based photoconductive layer.

In the case of the organic photoconductor, the hardness of the photoconductive layer is so low that the thickness of the photoconductive layer is decreased by 1 $\mu$m every about 10,000 copies when used in practice. As a matter of course, the chargeability of the organic photoconductor is gradually decreased while in use.

For example, in an organic photoconductor comprising an organic photoconductive layer with a thickness of 20 $\mu$m at the initial stage, a charging defect is caused when not more than 50,000 copies are made. Namely, the organic photoconductor disadvantageously has an extremely short lifespan. It can be considered that this problem may be solved by increasing the thickness of the organic photoconductive layer to more than 20 $\mu$m, for example, to about 40 $\mu$m. However, there is a limitation on the thickness of a film layer that can be made by a conventional coating film formation technique.

Furthermore, in order to charge the photoconductor to a high potential of about 500 V or more, a large-output-yielding charging unit and a corresponding long charging processing time are required. This brings about an increase in both the size of the charging unit and power consumption. In particular, in the case of an a-silicon based photoconductor, a large charging processing area is required because of its low charge-ability.

In the exposure step, there is required a light source with a sufficient amount of light emission for quick dissipation of electric charges from the surface of a photoconductor with a charging potential of about 500 V or more. Therefore, there are restrictions on the selection of a light source. Furthermore, the size of the exposure unit must be increased, so that high power consumption is required.

In addition to the above, since high voltage is required for the developing bias voltage, the entire size of the apparatus has to be increased and accordingly the power consumption is inevitably increased.

SUMMARY OF THE INVENTION

Accordingly, a first object of the present invention is to provide a carrier for use in a developer which is capable of forming images on a photoconductor with a low surface potential by the application of a low developing bias voltage thereto.

A second object of the present invention is to provide a developer comprising the above-mentioned carrier, which is capable of forming images on a photoconductor with a low surface potential by the application of a low developing bias voltage thereto.

A third object of the present invention is to provide an image formation method capable of forming images on an electrophotographic photoconductor with a relatively low charging potential by the application of a low developing bias voltage thereto.

A fourth object of the present invention is to provide an electrophotographic photoconductor suitable for use in the above image formation method.

The first object of the present invention can be achieved by a magnetic carrier for use in a developer for developing latent electrostatic images, which magnetic carrier comprises magnetic carrier particles with a particle size of 35 μm or less in an amount of 15 wt. % or more.

The second object of the present invention can be achieved by a developer comprising the above-mentioned carrier and a toner. In this developer, insulating toner particles can be used as the toner. When this developer is employed, toner images can be easily transferred to an image receiving medium such as a plain paper to form visible toner images thereon by an electrostatic image transfer method.

The third object of the present invention can be achieved by an image formation method comprising the steps of (a) uniformly charging the surface of a photoconductor to a predetermined polarity, (b) forming latent electrostatic images comprising low potential portions and high potential portions on the photoconductor by subjecting the charged surface of the photoconductor to selective light radiation corresponding to light images, thereby selectively reducing the potential of the surface of the photoconductor, and (c) developing the thus formed latent electrostatic images to visible toner images by bringing a developer into contact with the latent-electrostatic-images-bearing photoconductor, thereby causing the toner contained in the developer to be selectively deposited on the latent-electrostatic-images-bearing photoconductor, wherein as the above-mentioned developer, there is employed a developer comprising (i) a carrier which comprises magnetic carrier particles with a particle size of 35 μm or less in an amount of 15 wt. % or more, and (ii) a toner.

This image formation method makes it possible to simplify the charging, exposure and development processes, to reduce the size of the image formation apparatus, and the power consumption thereof.

Furthermore, this image formation method makes it possible to simplify the structure of the photoconductor employed therein and to increase the design freedom of the photoconductor.

These significant advantages of the image formation method according to the present invention lead to the overall improvement of an image formation system to be employed.

Furthermore, since a photoconductor with a low charging potential can be employed in the image formation method according to the present invention, the thickness of a photoconductive layer of the photoconductor can be reduced. The reduction of the thickness of the photoconductive layer will contribute to the improvements of the development characteristics of the photoconductor, and to the reduction of the consumption of energy and resources.

The fourth object of the present invention can be achieved by an electrophotographic photoconductor including a photoconductive layer which satisfies the relationship of $ke/d>0.3$ ($1/\mu m$) when the electrostatic capacity C of the photoconductive layer is represented by formula (I):

$$C=ke\times\epsilon o\times S/d \quad (I)$$

wherein ke is the specific inductive capacity of the photoconductive layer, Eo is the dielectric constant of vacuum, S is the area of the photoconductive layer, and d is the thickness of the photoconductive layer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
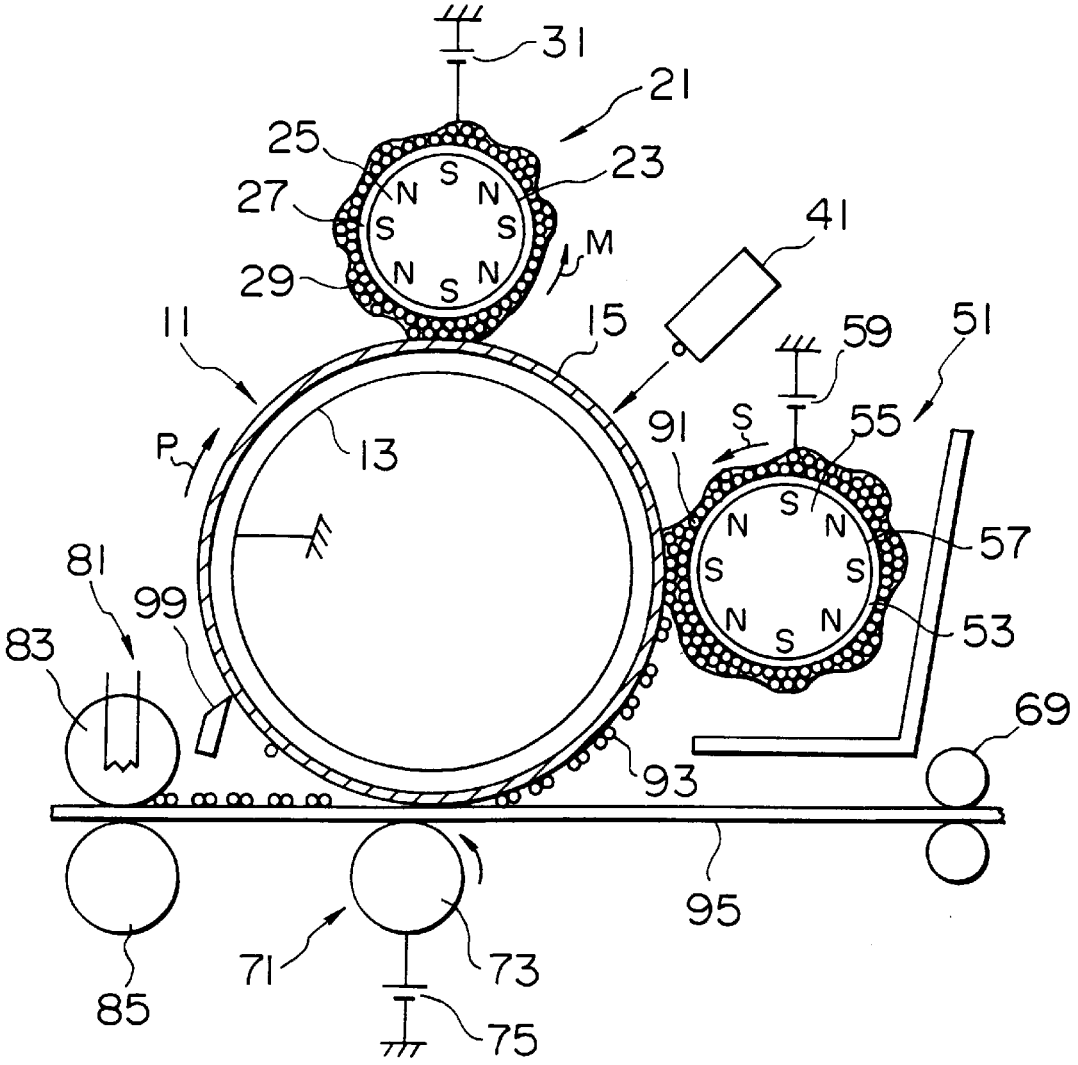
FIG. 1 is a schematic cross-sectional view of an image formation apparatus in explanation of an image formation method according to the present invention.

FIG. 1 is a schematic cross-sectional view of an image formation apparatus for explaining an example of an image formation method according to the present invention. In the figure, around a drum-shaped photoconductor 11 comprising an electroconductive support 13 and a photoconductive layer 15 provided thereon, there are situated a charging unit 21, an exposure unit (LED exposure optical system) 41, a developer unit 51, an image transfer unit 71, and an image fixing unit 81. As the photoconductor 11, a belt-shaped (or sheet-shaped) photoconductor may be employed.

In the present invention, a-silicon photoconductors, organic photoconductors (OPC), and selenium-based photoconductors which are conventionally used in practice can be employed as desired as the above-mentioned photoconductor. Furthermore, as will be described later, the photoconductor employed in the present invention may have a low surface potential at the charging step, so that organic photoconductive materials for use in organic and inorganic photoconductors, which conventionally cannot be used in practice as having too low charge-ability, can also be employed in the present invention.

Furthermore, since the photoconductive layer 15 may have a low surface charging potential, the thickness of the photoconductive layer 15 can be substantially reduced. For instance, in the case of an a-silicon photoconductor, a photoconductive layer with a thickness in the range of about 3 to 15 μm can be sufficiently used, so that the deposition time for producing the photoconductive layer can be significantly reduced, and the reduction of the occurrence of defects in the photoconductive layer during the formation thereof can be improved. These advantages contribute to a significant reduction of the production cost.

Furthermore, in the case of an organic photoconductor, an organic photoconductor with a photoconductive layer with a thickness of 3.3 μm or more can be sufficiently used for image formation in practice. Therefore, for example, when an organic photoconductor with a photoconductive layer with a thickness of 20 μm is employed, that photoconductor can be used for image formation until the thickness of the photoconductive layer is decreased to 3.3 μm by abrasion. When it is supposed that the photoconductive layer is abraded with a speed of 1 μm/10,000 copies, more than 150,000 copies can be made, so that the lifespan of the photoconductor can be significantly increased. As a matter of course, the lifespan of the photoconductive layer can be further increased if the initial thickness of the photoconductive layer is increased.

In an ideal situation, the development step in electrophotography is terminated when the electrostatic potential difference between a high potential portion and a low potential portion formed in a latent electrostatic image formed on the surface of a photoconductor is canceled by the charge of toner employed. In other words, when toner is deposited on the photoconductor and the above-mentioned potential difference is canceled by the charge of the toner, the photoconductor does not exert any force to move the toner or to cause to the toner to be deposited thereon any longer. At this moment, the development step is terminated. Therefore the development performance of a photoconductor can be improved by making some modifications to the photoconductor, by which the potential of the photoconductor is not substantially increased even when a predetermined quantity of charges is brought to the photoconductor by toner. If there is a potential difference on the surface of a photoconductor of which potential is difficult to increase, the photoconductor exerts force for transferring toner onto the surface of the photoconductor for performing development.

The structure of a photoconductor is basically the same as that of a condenser. Therefore, when the electrostatic capacity of a photoconductive layer of a photoconductor is increased, the quantity of electric charge necessary for elevating the potential of the photoconductive layer to a predetermined potential is increased. Thus, the development characteristics of a photoconductor can be improved by increasing the electrostatic capacity thereof as mentioned previously.

For this reason, in the present invention, it is preferable to use a photoconductive layer with a large electrostatic capacity.

The electrostatic capacity C of a photoconductive layer is represented by the following formula (I):

$$C=ke\times\epsilon o\times S/d \quad \text{(I)}$$

wherein ke is the specific inductive capacity of the photoconductive layer, εo is the dielectric constant of vacuum, S is the area of the photoconductive layer, and d is the thickness of the photoconductive layer.

It is preferable that the specific inductive capacity ke of the photoconductive layer be large and the thickness d of the photoconductive layer be small for use in the present invention.

The value of the specific inductive capacity ke depends upon the material and layer structure of the photoconductive layer. For instance, in the case of an a-silicon based photoconductor, the value of ke is in the range of about 11 to 12; in the case of a selenium based photoconductor, the value of ke is in the range of about 5.97 to 6.60; and in the case of an organic photoconductor, the value of ke is in the range of about 3 to 3.5.

When the thickness d of the photoconductive layer is decreased, the maximum charging potential of the photoconductive layer is decreased. In a conventional recording method, it is required that a photoconductive layer be charged with a high voltage, such as 400 V or more, so that the photoconductive layer must be thick enough for such charging with high voltage. Accordingly, the photoconductive layer for use in a conventional image formation method has limitations with respect to the reduction of the thickness thereof.

In contrast, the image formation method according to the present invention enables a photoconductive layer with a small potential difference to form images thereon with the formation of latent electrostatic images with a small potential difference on the photoconductive layer, so that it is possible to increase the electrostatic capacity C of the photoconductive layer with the thickness d of the photoconductive layer set at a small value.

To be more specific, preferably ke/d>0.3 (1/μm), more preferably ke/d>0.4 (1/μg), in the previously mentioned formula (I). The development characteristics of a photoconductor can be improved by setting the specific inductive capacity ke and the thickness d of the photoconductive layer.

First, the photoconductor 11 is charged in the dark by the charging unit 21. The charging unit 21 is constructed of an inner magnetic roller 25, a magnetic brush roller 23 having a charging sleeve 27, electroconductive and magnetic charging particles 29, and a charging bias power source 31. The charging particles 29, with the application of a voltage thereto from the charging bias power source 31 through the charging sleeve 27, serve as an electroconductive member which is brought into contact with the photoconductor 11 and charges the photoconductor 11 with charge injection thereto, and forms a magnetic brush with being magnetically bonded to the magnetic brush roller 23. Thus, the charging particles 29 are rotated in contact with the photoconductor 11 in accordance with the rotation of the magnetic brush roller 23.

The surface charging potential of the photoconductor 11 may be 500 V or less, preferably 400 V or less, and more preferably 350 V or less.

One of the key features of the image formation method according to the present invention is that the surface charging potential of a photoconductor employed can be significantly lowered. The minimum required surface potential may be a surface potential at which image formation can be performed, but is generally 30 V or more, preferably 50 V or more. The magnitude of the surface potential in this specification is shown by its absolute value, and the polarity thereof can be appropriately set as desired.

In the example shown in FIG. 1, as the charging unit 21, a contact charging unit using ma netic electroconductive particles is employed. Alternative to the charging unit 21, there can be employed contact charging units of other types using a conductive brush or a conductive roller, and corona charging units using a corotron charger or a scorotron charger. For such charging, the contact charging is easy because the required charge quantity is small. In both contact charging and corona charging, the charger can be reduced in size, and the power consumption can also be reduced. Also in the case where corona charging is employed, the amount of ozone generated is significantly smaller than that in a conventional image formation method. Furthermore, even when a photoconductor with a low chargeability, such as an a-silicon based photoconductor, is employed, the required charging time may be short and the entire size of the image formation apparatus can be made compact.

The photoconductor 11 with the surface thereof being uniformly charged is then exposed to a light image by a LED exposure optical system 41. By this exposure, the surface potential in the exposed areas of the photoconductor 11 is selectively reduced, whereby a latent electrostatic image composed of low potential portions and high potential portions, corresponding to the light image, are formed on the surface of the photoconductor 11. The potential difference between the low potential portions and the high potential portions may be 450 V or less, preferably 350 V or less, and more preferably 300 V or less. As mentioned previously, one of the key features of the image formation method of the present invention is that the low charging potential, that is, the contrast potential, may be significantly low. The lowermost limit of the low charging potential cannot be specified, but generally 50 V or more.

Thus according to the present invention, the reduction in the potential by the exposure may be small, so that the quantity of light for exposure may also be small. As a result, the freedom for the selection of an exposure unit can be increased, and the size of an exposure unit and power consumption can be reduced.

In the example shown in FIG. 1, which is supposed to be used as a printer, the potential of portions which will become an image area later on is lowered by the LED exposure optical system 41.

The LED exposure optical system 41 is composed of an LED array in which LED chips with a number equal to the number of recording picture elements are linearly arranged, and an image formation optical system comprising, for instance, a Selfoc lens array. Instead of the LED exposure optical system 41, a laser exposure optical system using rotary mirrors and f-θ lenses can be employed. For use in a copying machine, an optical system for copying machine, in which a photoconductor is exposed to the light reflected from an original document for copying, can be employed.

The latent electrostatic images formed on the photoconductor 11 are then developed to visible toner images by a developer unit 51. The developer unit 51 supplies a developer 91 onto the surface of the photoconductor 11 by a development roller 53. A developing bias power source 59 which applies a developing bias voltage between the photoconductor 11 and the development roller 53 is connected to an electroconductive development sleeve 57 of the development roller 53. The development roller 53 is composed of an inner magnetic roller 55 having several magnetic poles (N poles and S poles) and a development sleeve 57 in which the inner magnetic roller 55 is provided.

In the example shown in FIG. 1, the photoconductor 11 and the development roller 53 are rotated in the respective directions of the arrow P and the arrow S, whereby the developer 91 is transported and supplied onto the surface of the photoconductor 11. In the development roller 53, either the magnetic roller 55 or the development sleeve 57, or both the magnetic roller 55 and the development sleeve 57 may be rotated.

When development is conducted, a developing bias electric field is generated between the development roller 53 and the photoconductor 11 with the application of a bias voltage thereto from the developing bias power source 59. It is preferable that the developing bias voltage (the potential of the development sleeve 57) be 400 V or less.

By this development, the toner contained in the developer 91 is caused to be deposited selectively on the latent electrostatic images formed on the photoconductor 11, whereby visible toner images are formed on the photoconductor 11. For example, in the case where the photoconductor 11 is charged to a positive polarity, a latent electrostatic image is formed thereon by the reduction of the potential in the image forming portion with the exposure of the photoconductor 11 to a light image, and a visible toner image is formed by a reverse development method using a positively charged toner, the toner is caused to be selectively deposited on low potential portions on the photoconductor 11 by the potential difference between the applied developing bias voltage and the low potential portions, which serves as the driving force for the toner deposition. On the other hand, the positively charged toner which is in contact with the high potential portions on the photoconductor 11 overcomes the affinity of the toner for the photoconductor 11, such as the van der Waals force between the toner and the photoconductor 11, and is recovered into the developer 91 by the potential difference between the developing bias voltage and the high potential portions, which serves as the driving force for the toner recovery.

Figure 2:
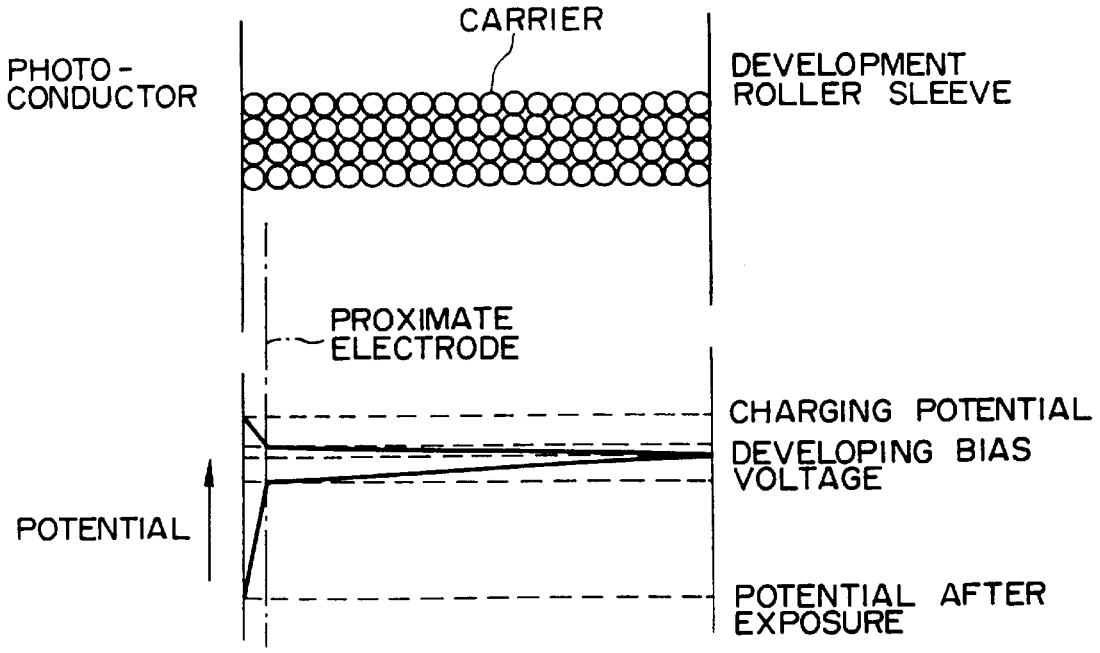
FIG. 2 is a diagram in explanation of the principle of the image formation method according to the present invention.

As will be explained later with reference to FIG. 2, the developing bias voltage is between the charging potential (the potential of the high potential portion in a latent electrostatic image) and the potential after exposure (the potential of the low potential portion in the latent electrostatic image) in terms of the magnitude value thereof.

It is preferable that the potential difference between the developing bias voltage and the potential of the low potential portion, that is, the potential difference between the developing bias voltage and the potential of the portion of the photoconductor on which toner is to be deposited, be 350 V or less, more preferable 300 V or less. As mentioned previously, there is no particular specific lower limit for this potential difference, but it is preferable that the lower limit on this potential difference be 10 V or more, more preferable 20 V or more.

It is also preferable that the potential difference between the developing bias voltage and the potential of the high potential portion, that is, the potential difference between the developing bias voltage and the potential of the portion of the photoconductor on which toner is not to be deposited, be 50 V or less, more preferable 30 V or less. There is no particular specific lower limit on this potential difference, but it is preferable that the lower limit on this potential difference be 10 V or more, more preferable 20 V or more.

In the Example of the present invention, the developing bias voltage is set at a lower potential than the potential of the high potential portion of the photoconductor, and by use of this potential difference, the toner in the high potential portion (the background portion) is recovered into the developer 91. It is not always necessary to limit this potential difference to the above-mentioned relationship. For instance, the developing bias voltage may be set at a higher potential than the potential of the high potential portion of the photoconductor. In this case, the toner in the high potential portion (the background portion) can be recovered into the developer 91 by use of a magnetic force, for instance, by using a magnetic toner, with the amount of a magnetic powder contained in the toner being increased, or by increasing the magnetic force of the magnetic roller 55.

In the Example of the present invention, a two-component developer comprising at least a magnetic carrier and an insulating toner is employed as the developer 91.

As the magnetic carrier, an electroconductive magnetic carrier with relatively low resistivity and a magnetic carrier with relatively high resistivity, which are conventionally employed, can be used equally without any modification.

For the magnetic carrier with relatively high resistivity, there can be employed, for instance, a ferrite carrier consisting of ferrite particles, a coating ferrite carrier composed of ferrite carrier particles coated with a synthetic resin, and a magnetic resin particle carrier made by dispersing magnetic particles such as magnetite particles in a resin and forming the dispersion into particles.

For the electroconductive magnetic carrier, particles which themselves have both electroconductivity and magnetic character, such as stabilized iron particles with a resistance layer on the surface thereof, can be used. Furthermore, for such an electroconductive magnetic carrier, particles prepared by forming an electroconductive layer on magnetic core particles to impart electroconductivity to the particles may also be employed. There are the following two representative types of core particles for use in the above-mentioned electroconductive magnetic carrier:

(1) magnetic resin core particles prepared by dispersing finely-divided particles of a magnetic material in a binder resin, thereby causing the binder resin to support the particles of a magnetic material.

(2) finely-divided magnetic core particles consisting of finely-divided magnetic particles of a material, such as ferrite and magnetite.

In order to provide an electroconductive surface layer on the core particles to impart electroconductivity to the core particles, the following methods (A), (B) and (C) can be employed:

Method (A):

Finely-divided electroconductive particles, such as electroconductive carbon black, are firmly fixed to the surface of magnetic core particles. This method is suitable for the above-mentioned magnetic resin core particles (1). Finely-divided electroconductive particles can be fixed to the surface of magnetic core particles by (i) dispersing finely-divided particles of a magnetic material in a binder resin to prepare magnetic core particles, (ii) uniformly mixing the thus prepared magnetic core particles and finely-divided electroconductive particles to deposit the finely-divided electroconductive particles on the surface of the magnetic core particles, and (iii) fixing the finely-divided electroconductive particles to the surface of the magnetic core particles by driving the electroconductive particles into the surface layer of the magnetic core particles with the application of a mechanical and/or thermal shock thereto. As such a surface-modification apparatus, for instance, "Hybridizer" (made by Nara Machinery Co., Ltd.) is commercially available. Such an electroconductive magnetic carrier is described in Japanese Laid-Open Patent Application 5-53368.

Method (B):

An electroconductive resin coating layer composed of a synthetic resin and finely-divided electroconductive particles dispersed therein is provided on the surface of magnetic core particles. This method can be applied to the above-mentioned magnetic resin core particles (1) and finely-divided magnetic core particles (2). Specifically, the following three methods (B-1), (B-2) and (B-3) can be employed:

(B-1) A resin is dissolved in a solvent. In this solution, finely-divided electroconductive particles are dispersed. The thus obtained dispersion is coated on the surface of the core particles. With the application of heat to the dispersion coated core particles, the solvent is eliminated by evaporation, whereby an electroconductive resin coated layer is formed on the surface of the core particles.

(B-2) A resin is dissolved in a solvent. In this solution, finely-divided electroconductive particles are dispersed. The thus obtained dispersion is coated on the surface of the core particles. With the application of heat to the dispersion coated core particles, the solvent is eliminated by evaporation, and the components of the resin are caused to be cross-linked or the polymerization thereof is caused to proceed, whereby an enhanced electroconductive resin coated layer is formed on the surface of the core particles.

(B-3) A monomer is directly polymerized on the surface of core particles such as ferrite particles in the presence of finely-divided electroconductive particles such as carbon black, so that an electroconductive resin coating layer is caused to grow and formed in such a manner that the finely-divided electroconductive particles are included therein. This method is described in Japanese Laid-Open Patent Application 2-187771 which recites Japanese Laid-Open Patent Application 60-106808.

Method (C):

An electroconductive thin film made of ITO (Indium-Tin-Oxide), indium oxide, tin oxide, aluminum, nickel, chromium or gold, is formed on the surface of magnetic core particles by a thin film formation method such as CVD method, vacuum deposition method, or sputtering method.

It is preferable that the electroconductive magnetic carrier generally have a volume resistivity in the range of $10^1$ to $10^5\Omega$cm, more preferably in the range of $10^2$ to $10^4\Omega$cm. When the volume resistivity of the electroconductive magnetic carrier is excessively large, a developing bias voltage necessary for develop-ment cannot be applied thereto, while when the volume resistivity is extremely small, the low potential portions formed on the surface of a photoconductor by the photoconductor being exposed to light is again charged. The volume resistivity of the electroconductive magnetic carrier is the value obtained when the resistivity thereof is measured under the conditions that 1.5 g of the electroconductive magnetic carrier is placed in a cylinder made of teflon with an inner diameter of 20 mm, having an electrode at the bottom thereof, and a counter electrode with an outer diameter of 20 mm is then fitted into the cylinder with the application of a pressure of 1 kg.

In the present invention, it is important that the magnetic carrier comprises magnetic carrier particles which include magnetic carrier particles with smaller particle sizes in order to attain the developer under the conditions of low charging potential and low electric field.

More specifically, it is preferable that the magnetic carrier particles which substantially constitute the magnetic carrier contain magnetic carrier particles with a particle size of 35 $\mu$m or less in an amount of 15 wt. % or more, more preferably in an amount in the range of 15 to 90 wt. %, of the entire weight of the magnetic carrier particles.

Furthermore, it is preferable that the magnetic carrier include magnetic carrier particles with a particle size of 25 $\mu$m or less in an amount of 15 to 50 wt. % of the entire weight of the magnetic carrier particles. It is more preferable that the magnetic carrier include magnetic carrier particles with a particle size of 20 $\mu$m or less in an amount of 15 to 30 wt. % of the entire weight of the magnetic carrier particles. The functions of the magnetic carrier particles with such small particle sizes will be explained later.

It is preferable that the average particle size of the magnetic carrier particles be in the range of 20 to 50 $\mu$m, more preferably in the range of 25 to 40 $\mu$m. When the relative amount of the magnetic particles with small particle sizes is extremely increased, the fluidity of the developer deteriorates, and uniform mixing and transportation of the developer are obstructed.

It is required that the magnetic carrier have a magnetic force beyond a certain extent. It is preferable that the maximum magnetization (magnetic flux density) of the magnetic carrier in a magnetic field with 5 KOe be 50 emu/g or more, more preferably in the range of 50 to 200 emu/g, further more preferably in the range of 60 to 180 emu/g. Further, it is preferable that the maximum magnetization (magnetic flux density) of the magnetic carrier in a magnetic field with 1 KOe be 40 emu/g or more, more preferably in the range of 40 to 90 emu/g, further more preferably in the range of 45 to 70 emu/g. When the magnetic force of the magnetic carrier is extremely small, the magnetic carrier is attracted toward the photoconductor during the development step and is then transferred to the photoconductor. This phenomenon is hereinafter referred to the "carrier attraction".

It is preferable that the insulating toner for use in the present invention have a volume resistivity of $10^{14}\Omega$cm or more, more preferably, $10^{15}\Omega$cm or more. The value of this volume resistivity is measured in the same manner as in the case of the magnetic carrier. The insulating toner may be either a magnetic toner or a non-magnetic toner.

As such toners, toners with the same structure as that of conventionally employed toners can be employed. For instance, such toners may contain a binder resin, a coloring agent, a charge controlling agent, and an preventing agent. Furthermore, such a toner may be made a magnetic toner with the addition of a magnetic material thereto in order to improve the development characteristics and to prevent the scattering of the toner within a copying machine.

As the binder resin for use in the toner, for instance, vinyl resins represented by a polystyrene-based resin such as styrene-acrylic copolymer, and polyester resins, can be employed.

As the coloring agent for use in the toner, a variety of dyes and pigments such as carbon black can be employed. As the charge controlling agent, for instance, quaternary ammonium compounds, nigrosine, nigrosine bases, Crystal Violet, and triphenylmethane compounds can be employed. As the offset-preventing agent or image-fixing improving agent, olefin waxes such as low molecular weight polypropylene, low molecular weight polyethylene and modified materials of the above compounds can be employed.

It is preferable that the average particle size of the toner be 20 $\mu$m or less, more preferably in the range of 5 to 15 $\mu$m.

In the present invention, a developer for developing latent electrostatic images is prepared by uniformly mixing magnetic carrier particles and toner particles with a particle size smaller than that of the magnetic carrier particles.

The volume resistivity of the developer is preferably in the range of $10^2$ to $10^7\Omega$cm, more preferably in the range of $10^3$ to $10^6\Omega$cm. The value of this volume resistivity is measured in the same manner as in the case of the magnetic carrier.

The development characteristics of the developer according to the present invention can be improved by adjusting the mixing ratio of the magnetic carrier particles and the toner particles. In the present specification, there is the case where carrier particles are simply referred to as carrier, and toner particles are simply referred to as toner when no particular misunderstanding is caused.

When the relative amount of the toner particles in the developer is increased, the development characteristics of the developer are increased, so that images with high density can be obtained. This is because the larger the number of charged particles in a predetermined space, the larger the amount of the charged particles that can be moved in a predetermined electric field in a predetermined period of time.

On the other hand, in the case of a two-component developer, it is required that the toner particles be sufficiently charged and held on the surface of the carrier particles. The toner particles come into contact with the surface of the carrier particles and are triboelectrically charged, whereby the toner particles are electrostatically deposited on the surface of the carrier particles. The carrier particles with the surface thereof being completely covered with the toner particles cannot come into contact with other toner particles, so that such carrier particles have no function to triboelectrically charge other toner particles. Therefore, when the amount of the toner is extremely large relative to the amount of the carrier, the carrier cannot always securely charge and hold the toner. This brings about the case where uncharged floating toner particles are present in the developer. Such uncharged floating toner particles are deposited on non-image-formation areas on the photoconductor, so that problems such as the fogging of the background of images are caused. Therefore, it is required that the carrier particles have a sufficient surface area for triboelectrically charging the toner particles and holing the charged toner particles thereon. The developer according to the present invention contains carrier particles with a small particle size in an amount more than a predetermined amount in addition to carrier particles with a large particle size as mentioned previously, so that in comparison with a conventional developer which contains carrier particles with a large particle size only, the developer of the present invention can securely have a larger surface area for holding the toner particles. Thus, the developer of the present invention can contain a large amount of toner particles while preventing the problems such as the fogging of the background of images, therefore can increase the concentration of the toner, and can yield high quality and high density images.

When the surface area of the carrier is determined as mentioned above, the amount of the toner particles that can be charged and held by the carrier can also be determined, so that an appropriate amount of the toner can be determined in accordance with the particle size distribution of the carrier.

In the present invention, when a maximum toner coating amount is defined as the amount of the toner particles which are deposited in one layer in the closest packing state on the surface of the magnetic carrier particles, it is preferable that the developer be composed of toner particles and carrier particles with the toner coating amount of the toner particles being in the range of 10 to 80%, more preferably in the range of 30 to 70%, of the maximum toner coating amount, whereby the development characteristics of the developer are significantly improved and high quality images can be obtained.

The maximum toner coating amount can be determined by measuring the projection area of the toner and the surface area of the carrier. In many cases, toner particles and carrier particles are not in the shape of a true sphere, but the above values can be approximately calculated from the particle size distribution thereof on the supposition that those particles are in the shape of a true sphere. The closest packing system is calculated as being simple rhombic. In this case, the case where the gaps between the deposited particles are packed in the simple rohmbic state is calculated.

In the carrier, developer, image formation system according to the present invention, it is important that a carrier particle component with a small particle size is employed, since by the presence of such a carrier particle component, the amount of the toner particles contained in the developer can be increased, and accordingly the concentration of the toner in the developer can be increased.

By the presence of such small-particle-sized carrier particles in the developer, a large amount of toner particles can be charged and held by the small-particle-sized carrier particles, so that a large amount of particles can be supplied within a predetermined period of time to the surface of a photoconductor with latent electrostatic images formed thereon. As a result, even in an image formation system in which the surface potential of a photoconductor is low in the charging step, and the potential difference between a high potential portion and a low potential portion formed on the photoconductor at the exposure step is small, the development characteristics are significantly improved, clear, high quality images can be obtained with high density.

Furthermore, according to the present invention, the surface of the carrier is large as a whole, and a large number of toner particles can be charged and held, so that the freedom of setting the range of the toner concentration can be increased, the toner concentration can be easily optimized in accordance with the requirements of the image formation system employed.

Furthermore, since the developer contains the small-particle-sized carrier particle component, the small-particle-sized carrier particles can enter between carrier particles with the average particle size, so that the density of the developer is increased, and as mentioned previously, the entire surface area of the carrier particles is also increased. Even if a large amount of an insulating toner is contained in the carrier under such conditions, the desired resistivity of the developer is much less changed in comparison with a developer which does not contain the small-particle-sized carrier component or which contains a small amount of the small-particle-sized carrier component. In other words, when an insulating toner is contained in the conventional carrier, the insulating toner easily enters the gaps between the carrier particles, so that chains of the magnetic carrier particles are cut by the insulating toner. As a result, the resistivity of the developer is increased even when a small amount of the insulating toner is present.

In contrast, in the present invention, the amount of the toner which enters the above-mentioned gaps between the carrier particles is so reduced that the resistivity of the developer can be maintained in a wide range. Therefore, the use of a carrier containing a small-particle-sized carrier component makes it possible to set the concentration of the toner in a wide range in view of the stability of the resistivity of the developer.

The above-mentioned effect of stabilizing the electric characteristics of the developer can be obtained both in the case where an electroconductive carrier is employed as the carrier, and in the case where a carrier with high resistivity is employed as the carrier, but this stabilizing effect is significant particularly when an electroconductive magnetic carrier which is easily influenced by the insulating toner is employed.

In the case where electroconductive carrier particles are employed in the carrier or developer of the present invention, the same effect as that obtained when an electrode for the application of a developing bias voltage is disposed in close vicinity to the surface of a photoconductor. This effect is referred to as the proximate electrode effect. Thus effect further facilitates the low charging—low electric field development.

With reference to FIG. 1, the electrode for the application of the developing bias voltage is the development sleeve 57. The gap between the development sleeve 57 and the surface of the photoconductor 11 serves as a development gap. The narrower the development gap, the more effectively the developing bias voltage can be applied. However, the photoconductor 11 and the development sleeve 57 are driven members and have limitations on the mechanical precision thereof, so that it is extremely difficult to set the development gap at 0.1 mm or less. In the present invention, however, since the proximate electrode effect works as mentioned above, even when the development gap is large, there can be obtained the same effect as that obtained when the electrode for the application of a developing bias voltage is disposed in close vicinity to the surface of the photoconductor 11.

The reasons for the above are considered as follows and will be explained with reference to FIG. 2 and FIG. 3.

Figure 3:
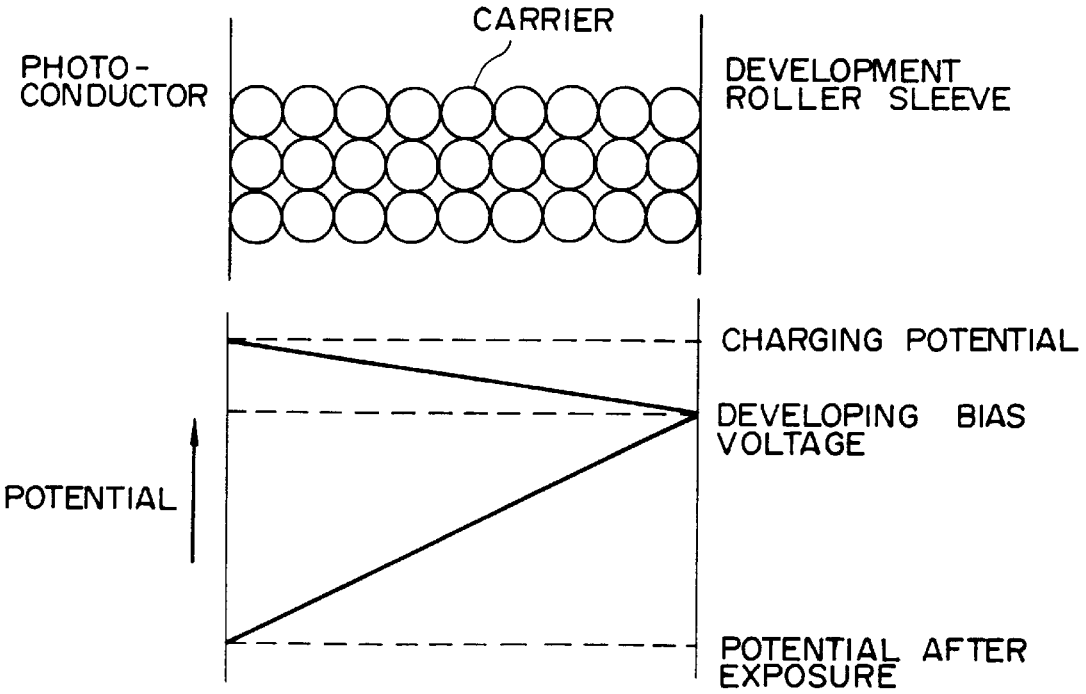
FIG. 3 PRIOR ART
FIG. 3 is a diagram in explanation of the principle of a conventional image formation method.

In a conventional two-component development system, the particle size of the carrier is large as illustrated in FIG. 3. Even when an electroconductive carrier is used as the carrier, the carrier has a larger resistivity than that of the carrier of the present invention. Therefore as shown in FIG. 3, the potential is substantially uniformly decreased from the development roller sleeve 57 which is a development electrode to the surface of the photoconductor. When it is supposed that the photoconductor is positively charged and a reverse development is conducted by use of a positively charged toner, the gradient of the potential (the intensity of the electric field) between the development roller sleeve 57 and the photoconductor formed by the potential difference between the potential after exposure and the developing bias voltage serves as the driving force for bringing the positively charged toner into contact with the surface of the photoconductor to perform the development of latent electrostatic images formed thereon. On the other hand, the gradient of the potential between the development roller sleeve 57 and the photoconductor formed by the potential difference between the charging potential in the non-exposed portion of the photoconductor and the developing bias voltage serves as the driving force for recovering the toner which is in contact with the non-exposed portion and bringing the recovered toner into the developer, thereby preventing the fogging of developed images. In a conventional image formation system, the particle size of a carrier employed is large, and the resistivity of a developer employed is also large, so that the gradient of the electric field between the development roller sleeve and the photoconductor becomes uniform. Therefore, unless the charging potential is set at a sufficiently high value, and the potential after exposure is set at sufficiently low value, a developing bias voltage necessary for the development and the prevention of the fogging of images cannot be set, and the developing bias voltage is inevitably set at a high value because the gradient of the potential (i.e. the intensity of the electric field) for the development is set at a large value.

In contrast to this, in the present invention, since the carrier contains a sufficiently small-particle-sized carrier component, many contact points at which the photoconductor and the development roller sleeve are electrically connected through the carrier can be formed, and the same effect as that obtained when a proximate electrode is disposed in close vicinity to the surface of the photoconductor because the electroconductivity of a magnetic brush composed of the carrier is high. For these reasons, in the present invention, the potential is neither decreased nor increased uniformly, but sharply rises with a large potential change in the direction from an imaginary proximate electrode in close vicinity to the surface of the photoconductor toward the surface of the photoconductor, so that a large gradient of the potential can be obtained. Since the magnitude of this gradient of the potential corresponds to that of the driving force for the development performance of the toner and the prevention of the fogging of images, it is possible to form high quality images even when the surface charging potential of the photoconductor is set at a low potential, and the difference between the charging potential and the potential after exposure is made small. As a matter of course, the developing bias voltage can be set at a low value.

Furthermore, the formation of the proximate electrode reduces the effect of the gap between the development roller sleeve and the photoconductor on the development characteristics, so that the adjustment of the development roller sleeve and the photoconductor (i.e. the development gap) is easy in the image formation method according to the present invention.

By the developer unit 51, visible images composed of the toner 93 are formed on the photoconductor 11. The toner 93 is transferred to an image receiving sheet 95 by an image transfer unit 71 which comprises an image transfer roller 73 to which a negative bias voltage is applied by an image transfer bias power source 75. Reference numeral 69 indicates register rollers for feeding the image receiving sheet 95.

The toner thus transferred to the image receiving sheet 95 is fixed thereto by an image fixing unit 81 which comprises an image fixing roller 83 which is a heat application roller. Reference numeral 85 indicates a pressure application roller. The residual toner which remains on the surface of the photoconductor 11, without being transferred to the image receiving sheet 95 during the image fixing step, is removed from the surface of the photoconductor 11 by a cleaning blade 99.

The above explanation is mainly directed to the image formation in which the photoconductor 11 is positively charged and images are formed by a reverse development using a two-component developer. The present invention is not limited to this development, but can be applied to other development processes including a normal development.

According to the present invention, high quality images can be formed on a photoconductor with a low charging potential with the application of a low developing bias voltage thereto. Therefore it is possible to simplify the process in each of charging, exposure and development steps and to reduce the size of the unit employed in each of the steps and the power consumption in each step. Furthermore, the structure of the photoconductor employed can be simplified and the freedom of the design thereof can be increased. These advantages make it possible to perform the significant improvements on the image formation system in its entirety.

Furthermore, since the charging potential of the photoconductor employed in the present invention may be low, the thickness of a photoconductive layer of the photoconductor can be decreased. This advantage makes it possible to improve the development characteristics thereof and contributes to the reduction of energy and resources.

The features of this invention will become apparent in the course of the following description of exemplary embodiments, which are given for illustration of the invention and are not intended to be limiting thereof.

EXAMPLE 1

(1) Preparation of Electroconductive Magnetic Carrier

A mixture of the following components was mixed and kneaded, pulverized in a jet mill, and classified, whereby carrier core particles were obtained:

| | Parts by Weight |
|---|---|
| Styrene/n-butyl acrylate copolymer (copolymerization ratio: 80/20) | 25 |
| Magnetite | 75 |

2 parts by weight of electroconductive carbon black serving as finely-divided electroconductive particles, with an average particle size in the range of 20 to 30 nm, were mixed with 100 parts by weight of the above obtained carrier core particles. This mixture was sufficiently mixed in a Henschel mixer, whereby the electroconductive carbon black was uniformly deposited on the surface of the carrier core particles.

The electroconductive carbon black in the form of finely-divided particles was then fixed to the surface of the carrier core particles with the application of mechanical impact thereto by a commercially available surface treatment apparatus ("Hybridizer" made by Nara Machinery Co., Ltd.), whereby an electroconductive magnetic resin carrier according to the present invention was obtained.

The properties of this carrier were as follows:

| | |
|---|---|
| Volume resistivity: | $5 \times 10^3\ \Omega \cdot cm$ |
| Saturation magnetization: | 64 emu/g (5 KOe) |
| Amount ratio of carrier particles with a particle size of 35 $\mu$m or less | 40 wt. % |

(2) Preparation of Toner

A mixture of the following components was mixed and kneaded, pulverized in a jet mill, and classified, whereby a toner with an average particle size of 10 $\mu$m was obtained:

| | Parts by Weight |
|---|---|
| Styrene/n-butyl acrylate copolymer (copolymerization ratio: 80/20) | 73 |
| Magnetite | 15 |
| Carbon black | 5 |
| Polypropylene wax | 5 |
| Charge controlling agent | 2 |

(3) Preparation of Developer and Image Formation

The above prepared carrier and toner were mixed with a toner concentration ratio of 20 wt. % in terms of the weight ratio of toner (T)/developer (D), whereby a developer with a volume resistivity of $2\times10^4\Omega$cm was prepared.

By use of the apparatus shown in FIG. 1 and the above-prepared developer, image formation was carried out under the following conditions, whereby clear images with high image density were obtained:

| | |
|---|---|
| Photoconductor surface charging potential: | 70 V |
| Potential after exposure: | 5 V |
| Developing bias potential: | 50 V |

In this image formation, the amount of the toner particles contained in the developer was 60% of the maximum toner coating amount. As the photoconductor, an a-silicon based photoconductor with a 10 $\mu$m thick photoconductive layer with a specific inductive capacity Ke of 11 was employed. The ratio of the specific inductive capacity Ke to the thickness d of the photoconductive layer, that is, ke/d, was 1.1 (1/$\mu$m).

EXAMPLE 2

An ethylene gas containing electroconductive carbon black was supplied onto the surface of ferrite particles, and an electroconductive polyethylene coating film was directly formed on the surface of the ferrite particles in accordance with the method described in Japanese Laid-Open Patent Applications 2-187771 and 60-106808, whereby an electroconductive magnetic carrier was produced.

The magnetic force of this carrier was 60 emu/g in a magnetic field of 1 KOe.

By the above-method, carriers with variously different average particle sizes were prepared with the amount of the carrier particles with a particle size of 20 μm or less being set at 15 wt. %. The resistivity of each carrier was measured. The results are shown in Table 1.

A negatively chargeable toner with an average particle size of 8 μm was mixed with each of the above prepared carriers in such a mixing ratio of 10% in terms of T/D, whereby developers were prepared. The resistivity of each of the developers was measured. The results are shown in Table 1.

By use of the apparatus as shown in FIG. 1, image formation was carried out on an organic photoconductor with a photoconductive layer with a thickness of 22.5 μm (d=22.5 μm), by uniformly charging the photoconductive layer to a surface potential of −140 V by a particle charging method, exposing the uniformly charged photoconductive layer to a light image to form a latent electrostatic image with a potential of −30 V after the exposure, and developing the latent electrostatic image with each of the above prepared developers with the application of a developing bias voltage of −110 V to visible toner images. The thus obtained images were evaluated and the results are shown in Table 1.

The specific inductive capacity ke of the photoconductive layer of the organic photoconductor was 2.0 (ke =2.0), and ke/d was 0.089 (1/μm) (ke/d =0.089 (1/μm)). The amount of the toner particles contained in each of the developers was in the range of 35 to 65% of the maximum toner coating amount.

TABLE 1

Results of Evaluation

| Average Particle Size of Carrier | Resistivity of Carrier (Ω · cm) | Resistivity of Developer (Ω · cm) | Evaluation of Images *1 | Overall Evaluation *1 |
|---|---|---|---|---|
| 25 μm | $2 \times 10^2$ | $7 \times 10^3$ | ○ | ○ |
| 30 μm | $2 \times 10^2$ | $1 \times 10^4$ | ○ | ○ |
| 32.5 μm | $3 \times 10^2$ | $2 \times 10^4$ | ○ | ○ |
| 35 μm | $2.5 \times 10^2$ | $3 \times 10^4$ | ○ | ○ |
| 37.5 μm | $3 \times 10^2$ | $8 \times 10^4$ | ○ | ○ |
| 40 μm | $3.5 \times 10^2$ | $2 \times 10^5$ | Δ | Δ |

*1) ○ : Extremely Good
Δ: Good
X: No Good

EXAMPLE 3

Varieties of carriers were prepared in the same manner as in Example 2 except that the average particle size of the carrier particles was fixed at 35 μm, and the weight percentage of the amount of carrier particles with a particle size of 20 μm or less (i.e. the small-particle-sized carrier particle component) was variously changed.

Developers were prepared by use of these carriers in the same manner as in Example 1. By use of these developers, image formation was carried out and the formed images were evaluated and the fluidity of each of the developers was also evaluated. The results are shown in Table 2.

The amount of the toner particles contained in each of the developers was in the range of 35 to 65% of the maximum toner coating amount.

TABLE 2

Results of Evaluation

| Amount of Carrier with small Particle Size | Resistivity of Carrier (Ω · cm) | Resistivity of Developer (Ω · cm) | Evaluation of Images *1 | Fluidity |
|---|---|---|---|---|
| 0 wt. % | $5 \times 10^3$ | $3 \times 10^6$ | X | Good |
| 5 wt. % | $1 \times 10^3$ | $2 \times 10^6$ | X | Good |
| 10 wt. % | $3 \times 10^2$ | $2 \times 10^5$ | Δ | Good |
| 15 wt. % | $2.5 \times 10^2$ | $3 \times 10^4$ | ○ | Good |
| 20 wt. % | $2.5 \times 10^2$ | $7 \times 10^3$ | ○ | Good |
| 30 wt. % | $2 \times 10^2$ | $1 \times 10^3$ | ○ | Good |
| 35 wt. % | $2 \times 10^2$ | $1 \times 10^3$ | Δ | No Good |

*1) ○ : Extremely Good
Δ: Good
X: No Good

What is claimed is:

1. A magnetic carrier comprising magnetic carrier particles for use in a developer for developing latent electrostatic images, said magnetic carrier particles having an average particle size between 20 and 50 μm, and having at least one of a maximum magnetization of between 50 and 200 emu/g in a magnetic field of 5 KÖe, and a maximum magnetization of between 40 and 90 emu/g in a magnetic field of 1 KÖe, wherein the magnetic carrier particles having a particle size of 35 μm or less constitute 15 to 90 wt. % of the magnetic carrier, and wherein said magnetic carrier particles having the particle size of 20 μm or less constitute 15 to 30 wt. % of the magnetic carrier.

2. A magnetic carrier as claimed in claim 1, wherein said magnetic carrier particles have a volume resistivity in the range of $10^1$ and $10^5$Ωcm.

3. A developer for developing latent electrostatic images, the developer comprising:

a toner, the toner comprising a plurality of toner particles, and a magnetic carrier, the magnetic carrier comprising a plurality of magnetic carrier particles, the magnetic carrier particles having an average particle size in the range of 20 to 50 μm and having at least one of a maximum magnetization of between 50 and 200 emu/g in a magnetic field of 5 KÖe, and a maximum magnetization of between 40 and 90 emu/g in a magnetic field of 1 KÖe, wherein the magnetic carrier particles having a particle size of 35 μm or less constitute 15 to 90 wt. % of the magnetic carrier, and of not greater than 20 μm constitute 15 to 30 wt. % of the magnetic carrier, wherein the plurality of toner particles are capable of being charged and held to the magnetic carrier particles and, the plurality of magnetic carrier particles are capable of attracting the plurality of toner particles.

4. A developer as claimed in claim 3, wherein said magnetic carrier particles have a volume resistivity in the range of $10^1$ and $10^5$Ωcm.

5. A developer as claimed in claim 3, wherein said magnetic carrier particles have a volume resistivity in the range of $10^1$ and $10^5\Omega$cm, and said developer has a volume resistivity in the range of $10^2$ and $10^7\Omega$cm.

6. A developer for developing latent electrostatic images, comprising:

a toner comprising a plurality of toner particles, and a magnetic carrier comprising a plurality of magnetic carrier particles, the magnetic carrier particles having an average particle size in the range of 20 to 50 $\mu$m and having at least one of a maximum magnetization of between 50 and 200 emu/g in a magnetic field of 5 K Öe, and a maximum magnetization of between 40 and 90 emu/g in a magnetic field of 1 KÖe, wherein the magnetic carrier particles having a particle size not greater than 35 $\mu$m constitute 15 to 90 wt. % of the magnetic carrier, and the magnetic carrier particles have a volume resistivity between $10^1$ and $10^5\Omega$cm, the magnetic carrier particles defining a surface on which a layer of the toner particles are depositable, the quantity of the toner particles depositable in one layer in a closest packing state on the surface of the magnetic carrier particles defining a maximum toner coating amount, and the toner particles being present in the developer in an amount equal to between 10 and 80% of the maximum toner coating amount, wherein the magnetic carrier particles having the particle size not greater than 20 $\mu$m constitute between 15 and 30 wt. % of the magnetic carrier.

7. A developer of claim 6, wherein the developer has a volume resistivity in the range of $10^2$ to $10^7\Omega$cm.

* * * * *